US006116501A

United States Patent [19]

Hupp

[11] Patent Number: 6,116,501

[45] Date of Patent: Sep. 12, 2000

[54] STACKABLE, SELF-SUPPORTING CONTAINER WITH LID-ALIGNMENT FEATURE

[75] Inventor: Matthew Todd Hupp, Sharonville, Ohio

[73] Assignee: The Procter & Gamble Company, Cincinnati, Ohio

[21] Appl. No.: 09/296,817

[22] Filed: Apr. 22, 1999

[51] Int. Cl.[7] ..... B65D 5/36; B65D 5/66

[52] U.S. Cl. ..... 229/125.09; 220/359.1; 220/359.2; 220/789; 220/791; 220/800; 220/801; 229/117.05; 229/125.13; 229/125.17; 229/125.35

[58] Field of Search ..... 229/117.01, 117.05, 229/125.08, 125.09, 125.11, 125.13, 125.17, 125.27, 125.35, 123.1; 220/789, 791, 793, 800, 801, 805, 359.1, 359.2, 338, 339

[56] References Cited

U.S. PATENT DOCUMENTS

| | | | |
|---|---|---|---|
| 584,555 | 6/1897 | Lorenz . | |
| 605,343 | 6/1898 | Ross . | |
| 2,573,309 | 10/1951 | Chipkevich . | |
| 2,893,295 | 7/1959 | Magill . | |
| 2,925,949 | 2/1960 | Locke | 229/117.01 |
| 2,951,765 | 9/1960 | Robson . | |
| 3,197,062 | 7/1965 | Day et al. | 221/48 |
| 3,306,492 | 2/1967 | Kugler | 221/63 |
| 3,319,684 | 5/1967 | Calhoun | 150/8 |
| 3,443,720 | 5/1969 | Roy | 220/791 |
| 3,462,067 | 8/1969 | Shore . | |
| 3,682,372 | 8/1972 | Rodley . | |
| 3,738,565 | 6/1973 | Ackley et al. . | |
| 3,784,055 | 1/1974 | Anderson | 221/46 |
| 3,819,043 | 6/1974 | Harrison | 206/449 |
| 3,899,117 | 8/1975 | Peyser et al. | 229/125.17 |
| 3,970,241 | 7/1976 | Hanson . | |
| 4,131,195 | 12/1978 | Worrell, Sr. | 206/205 |
| 4,183,458 | 1/1980 | Meyers . | |
| 4,185,754 | 1/1980 | Julius | 221/63 |
| 4,285,461 | 8/1981 | Meyers | 229/125.08 |
| 4,380,447 | 4/1983 | VanderLugt, Jr. | 229/125.17 |
| 4,411,374 | 10/1983 | Hotchkiss | 221/63 |
| 4,420,080 | 12/1983 | Nakamura | 206/449 |
| 4,427,148 | 1/1984 | Seiter et al. | 229/123.1 |
| 4,458,810 | 7/1984 | Mahoney | 206/210 |
| 4,487,318 | 12/1984 | Roen | 206/554 |
| 4,540,091 | 9/1985 | Haböck | 206/494 |
| 4,571,337 | 2/1986 | Cage et al. | 426/107 |
| 4,681,240 | 7/1987 | Wyant | 221/48 |
| 4,735,317 | 4/1988 | Sussman et al. | 206/449 |
| 4,736,450 | 4/1988 | Van Erden et al. | 383/65 |
| 4,753,351 | 6/1988 | Guillin . | |
| 4,790,436 | 12/1988 | Nakamura | 206/449 |
| 4,808,421 | 2/1989 | Mendenhall et al. | 426/107 |
| 4,833,862 | 5/1989 | Bortolani et al. | 53/427 |
| 4,848,930 | 7/1989 | Williams et al. | 383/104 |
| 4,863,064 | 9/1989 | Dailey, III | 221/48 |
| 4,892,220 | 1/1990 | Foos . | |
| 4,898,477 | 2/1990 | Cox et al. | 383/33 |
| 4,930,644 | 6/1990 | Robbins, III | 215/1 C |
| 4,979,613 | 12/1990 | McLaughlin et al. | 206/233 |
| 5,044,774 | 9/1991 | Bullard et al. | 383/34.1 |
| 5,048,718 | 9/1991 | Nakamura | 221/35 |

(List continued on next page.)

*Primary Examiner*—Gary E. Elkins
*Attorney, Agent, or Firm*—W. Scott Andes; Larry L. Huston; Donald E. Hasse

[57] ABSTRACT

A container having a container body, an open end and an opposed bottom. Around the open end of the container is a substantially continuous outwardly extending flange. The container has a lid for closing the container. The container flange and lid include complementary recesses and protrusions which ensure alignment of the lid with the flange when the lid is in the closed position. The container may have a tubular structure formed by two opposed side walls and two opposed end walls between the side walls. Opposed walls may have gussets, so that the walls are inwardly foldable towards each other and the container is collapsible and/or self-supporting. The container may also be collapsible via folding of the tubular structure.

8 Claims, 3 Drawing Sheets

U.S. PATENT DOCUMENTS

| | | | |
|---|---|---|---|
| 5,050,737 | 9/1991 | Joslyn et al. | 206/494 |
| 5,061,500 | 10/1991 | Mendenhall | 426/118 |
| 5,076,436 | 12/1991 | Bortolani et al. | 206/524.8 |
| 5,145,091 | 9/1992 | Meyers | 221/45 |
| 5,180,599 | 1/1993 | Feldmeier et al. | 229/125.35 |
| 5,195,829 | 3/1993 | Watkins et al. | 383/100 |
| 5,201,164 | 4/1993 | Kaufman | 54/436 |
| 5,242,057 | 9/1993 | Cook et al. | 206/581 |
| 5,314,252 | 5/1994 | Happ | 383/126 |
| 5,316,603 | 5/1994 | Akazawa et al. | 156/69 |
| 5,364,189 | 11/1994 | Kuge et al. | 383/61 |
| 5,379,897 | 1/1995 | Muckenfuhs et al. | 206/494 |
| 5,439,132 | 8/1995 | Gorlich | 220/359 |
| 5,507,579 | 4/1996 | Sorenson | 383/207 |
| 5,524,990 | 6/1996 | Buck | 383/34 |
| 5,547,284 | 8/1996 | Imer | 383/104 |
| 5,575,747 | 11/1996 | Dais et al. | 493/213 |
| 5,577,627 | 11/1996 | Richie-Dubler | 220/4.23 |
| 5,605,594 | 2/1997 | May | 156/244.22 |
| 5,609,899 | 3/1997 | Spector | 426/111 |
| 5,662,758 | 9/1997 | Hamilton et al. | 156/221 |
| 5,996,882 | 12/1999 | Randall | 229/117.05 |

STACKABLE, SELF-SUPPORTING CONTAINER WITH LID-ALIGNMENT FEATURE

FIELD OF THE INVENTION

The present invention relates to storage containers, particularly those suitable for use in the containment and protection of various items including perishable materials. The present invention further relates to such storage containers having improved sealability for containment and protection of items contained within under a wide range of in-use conditions.

BACKGROUND OF THE INVENTION

In response to consumer interest, a number of comparatively inexpensive storage containers have been developed which are made of polymeric materials and which are suitable for a wide variety of storage uses. Such containers attempt to combine the advantages of both flexible storage bags and durable, reusable, stackable storage containers. While many of these containers utilize conventional interlocking mechanical beads and grooves to effect sealing of the lid/container interface, a few recently-developed storage containers utilize protected adhesive regions on mating surfaces of the lid and/or container to form an adhesive seal when desired. Representative storage containers of this variety are disclosed in commonly-assigned, co-pending U.S. patent applications Ser. Nos. 08/853,773 and 08/854,246, the disclosures of which are hereby incorporated herein by reference.

While storage containers of the latter variety provide a number of advantages versus containers employing conventional mechanical seals, the generally planar contact surfaces of the lid and container flange utilized for the adhesive seal are not necessarily self-aligning. When a consumer begins to activate the adhesive seal at one edge or corner of the container, unless proper alignment is achieved from the outset a misaligned edge may deviate from proper alignment by an amount exceeding the width of the sealing surfaces by the time a more distant edge or corner is reached during the sealing operation. This possibility is perhaps even more likely with a truly separate lid as opposed to a hingedly-attached lid which is generally properly aligned at at least one edge. Once such a misalignment exceeds the amount of overlap of the sealing surfaces, the consumer (if the condition is identified by the consumer) must unseal the lid and container and re-initiate the sealing process. Misalignment may also occur due to out-of-plane distortion of the flange and/or lid. If, however, such misalignment goes unnoticed by the consumer, perishable items within the container may unexpectedly degrade during storage.

Accordingly, it would be desirable to provide a storage container having a improved sealability in use.

SUMMARY OF THE INVENTION

The present invention provides a container comprising: (a) a semi-enclosed container body including a tubular structure having two open ends and a bottom panel enclosing one end of the container body, the other end of the tubular structure opposite from the bottom panel forming a substantially continuous outwardly-extending peripheral flange; (b) a lid for selectively converting the semi-enclosed container to a closed container; and (c) a closure means for sealing the lid to the container body; wherein the flange and the lid each include a plurality of complementary recesses and protrusions to ensure alignment of the lid with the flange.

The container is preferably stackable and self-supporting, and the closure means preferably comprises an adhesive material. The container may also be collapsible via folding of the tubular structure.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
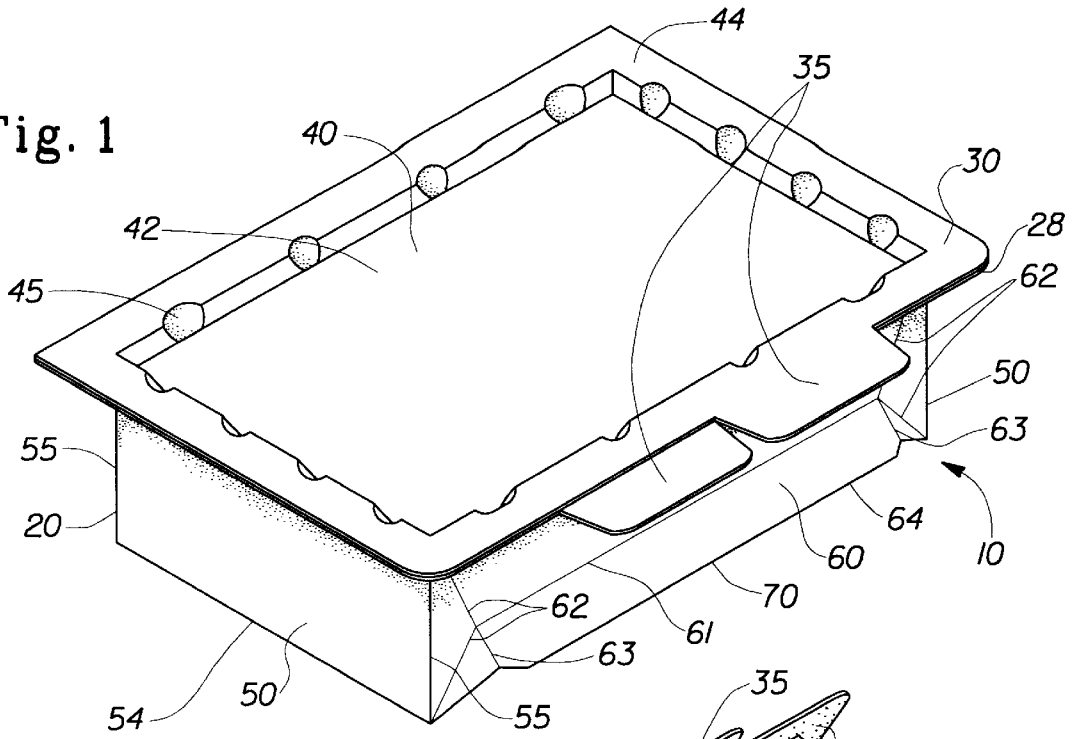
FIG. 1 is a perspective view of a storage container in accordance with the present invention in a closed condition.

FIG. 1 depicts a presently preferred embodiment of a storage container 10 according to the present invention. In the embodiment depicted in FIG. 1, the storage container 10 includes a container body 20 preferably unitarily formed from a piece of sheet material and a lid 40 which may be unitarily formed with the container body 20 or hingedly attached to the container body, but may also be a separate element. Storage container 10 also includes closure means 30 located adjacent to edge 28 for sealing the peripheral portions of the lid 40 and container body 20 to form a fully-enclosed container or vessel as shown in FIG. 1. Closure means 30 may comprise the marginal portion of the lid 40, the marginal flange portion 25 of the container body 20, or both. Closure means 30 is selectively openable, sealable, and resealable, as will be described hereinafter. If a hinge line is employed, the hinge line preferably comprises a unitary living hinge, and may optionally be provided as a line of weakness by scoring, perforations, or the like which may optionally permit the lid to be separated from the container body.

In the preferred configuration depicted in FIG. 1, the closure means 30 completely encircles the periphery of the opening formed by edge 28. However, under some circumstances a closure means formed by a lesser degree of encirclement (such as, for example, a closure means disposed along all portions of edge 28 except the hinged portion if a hinge line is employed) may provide adequate closure integrity. The flange 25 may be either unitarily formed with the container body 20 or provided as a separate material element joined to the container body. When provided as a separate, preferably more rigid material element, it is presently preferred that the container body material be formed into at least a small peripheral flange at its upper edge (defining the opening) with pleated corners so as to form a suitable junction point for joining the container body to the flange. The closure means may be provided on mating portions of either the flange 25, the lid 40, or both.

Figure 2:
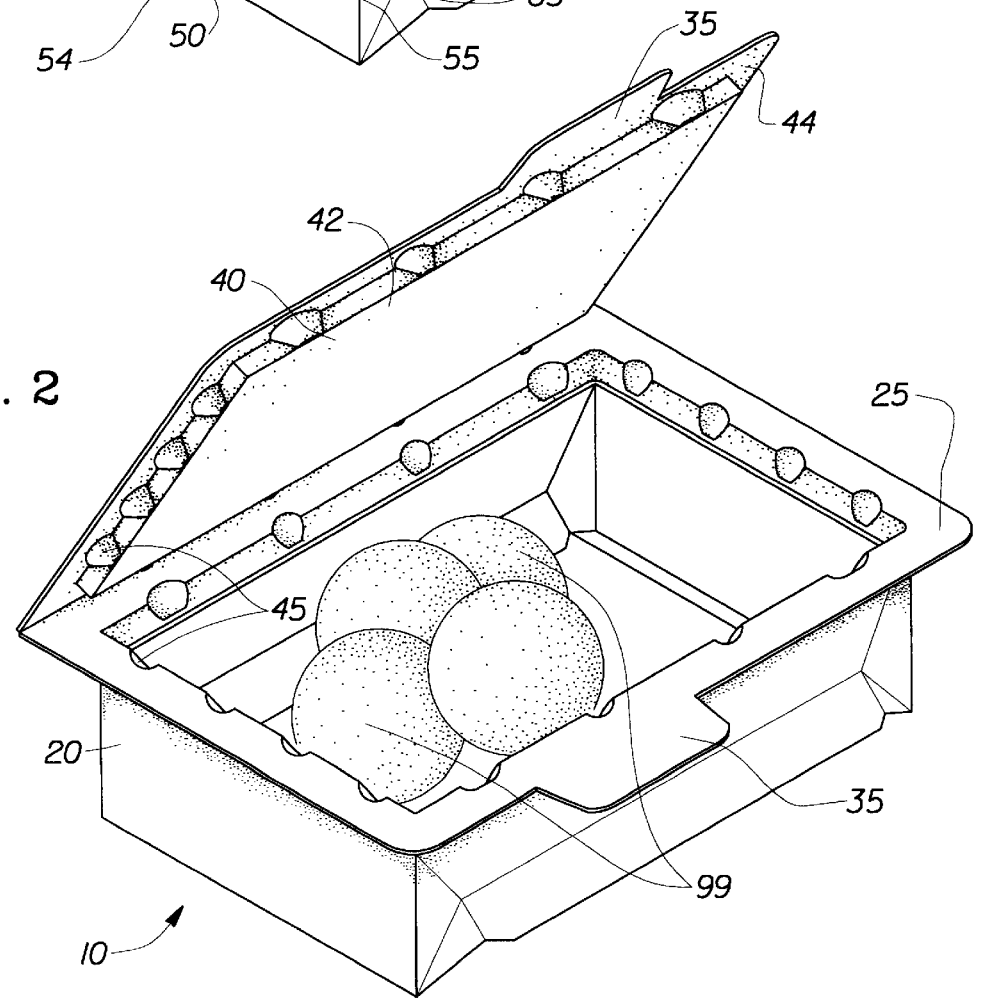
FIG. 2 is a perspective view of the storage container of FIG. 1 in an open condition and partially filled with solid objects.
Figure 3:
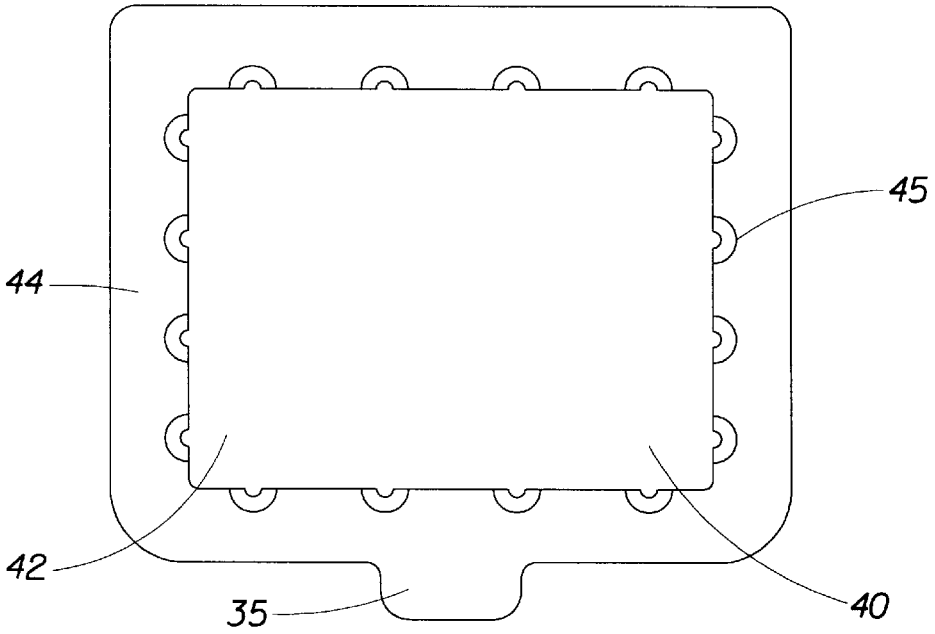
FIG. 3 is a top plan view of the storage container of FIG. 1, more clearly depicting the lid-alignment feature of the present invention.

FIG. 3 is a plan view more clearly depicting the lid-alignment feature of the present invention. As shown in FIGS. 1–3, the lid-alignment feature of the present invention comprises a plurality of upwardly-concave recesses 45 which are formed into the inner edge of the flange 25 and the complementary outward edge of the central lid panel 42, which projects at least slightwardly downwardly from the lid frame 44 so as to form at least a partial plug fit within the flange. These recesses may have a curved profile or may have linear sidewalls so as to be more conical in shape. In a configuration having a polygonal cross-section such as the rectangular container depicted in the drawing figures, each side edge of the flange and lid preferably contains a plurality of recesses 45 for added security against misalignment. In a presently preferred configuration, the recesses are preferably symmetrically arranged along opposing side edges and preferably substantially equally spaced around the periphery of the container. The recesses provide additional stability for the lid and flange to resist out-of-plane distortion, in addition to providing for lateral alignment. Other "recess" geometries may be employed other than the presently preferred arrangement wherein structures protrude from the lid and engage recesses in the flange, such as structures protruding from the flange to engage recesses in the lid. Additionally, with thin materials the presently preferred recess structure forms a recess on one side of the element and a protrusion on the other side, although if thick materials are used for the lid or container body only a mating protrusion and recess may be visible.

Storage container 10 is suitable for containing and protecting a wide variety of materials and/or objects contained within the container body. FIG. 2 depicts the storage container 10 in an open condition wherein the closure means 30 has been released such that edge 28 may be opened to admit materials and/or objects into the interior of the body portion of the storage container 10. In FIG. 2 a plurality of generic solid objects 99 are shown within the storage container 10.

Lid 40 is preferably of unitary construction and comprises a central lid panel 42 and a lid frame 44, either of which may be formed of various elements if desired. The ability to construct the container of multiple composite elements permits the use of diverse materials such as transparent polymeric panels for lid panels or more rigid, resilient materials for flanges and lid frames independently of the tailoring of materials for the container body 20. As best shown in FIGS. 1 and 2, the central lid panel 42 preferably extends downwardly to form a pan-shaped lid which forms a plug seal by fitting into a complementary recess or shelf in the upper portion of the container body for enhanced sealing capability.

In the embodiment of FIG. 1, the storage container 10 comprises two generally planar end panels 50, two generally planar, gusseted side panels 60, and a generally planar bottom panel 70, which panels form a semi-enclosed container having an opening defined by upper flange 25. End panels 50 include side edges 55 and bottom edges 54, while side panels 60 include bottom edges 64 and gussets of generally conventional design having converging base creases 62 and medial creases 61, with lateral creases 63. The creases are preferably formed into the material as lines of weakness via molding thinned areas into the material, scoring, or other suitable methods. In the configuration depicted in FIG. 1, the storage container is in its self-supporting, open condition. Flange 25 is preferably sufficiently resilient and rigid to aid in holding the open end of the container in an open condition as shown in FIG. 1.

While the storage container described above with regard to FIG. 1 provides many advantages compared with flexible storage bags and storage containers commonly available, it also includes additional features to enable the container to assume a self-supporting configuration to facilitate product access and product filling without manual support for greater ease of use.

As utilized herein, the term "flexible" is utilized to refer to materials which are capable of being flexed or bent, especially repeatedly, such that they are pliant and yieldable in response to externally applied forces. Accordingly, "flexible" is substantially opposite in meaning to the terms inflexible, rigid, or unyielding. Materials and structures which are flexible, therefore, may be altered in shape and structure to accommodate external forces and to conform to the shape of objects brought into contact with them without losing their integrity.

As utilized herein, the term "self-supporting" is utilized to refer to materials, structures, or containers which are capable of maintaining their orientation in a plane parallel to the direction of the force of gravity. For example, a self-supporting material, particularly a sheet material, may be held so that it extends upwardly parallel to the direction of the force of gravity and maintain its orientation without folding over or collapsing. Non-self-supporting materials typically will fold over or collapse and not be capable of being held parallel to the force of gravity (i.e., "vertically") unless they are held so that they extend downwardly from their point of support. Correspondingly, a self-supporting bag or container is capable of maintaining its orientation with surfaces extending upwardly from their base of support in opposition to the force of gravity without folding over upon itself or collapsing.

The closure means depicted in FIGS. 1–3 may be constructed in any known fashion utilizing any closure configuration, such as folds, pleats, adhesives, or mechanical interlocking closures such as ribs, beads, and grooves, which are known in the art. Adhesive surfaces with or without texture may be employed. However, it is presently preferred to utilize a selectively activatible adhesive-bearing structure which provides a secure closure seal upon activation. Accordingly, the closure means preferably comprises a selectively activatible adhesive-like material which bonds opposing material surfaces to one another across the opening formed by flange 25 in FIG. 2. The bond between the closure means and a target surface is also sufficient to provide a barrier seal against transmission of oxygen, moisture/moisture vapor, odor, etc. such that perishable items may be satisfactorily enclosed and preserved to the extent of the barrier properties of the material itself. The target surface may comprise a separate element of the container or may comprise another region of the closure means itself.

As utilized herein, the term "selectively activatible" is used to refer to materials which exhibit substantially non-adherent properties when brought into contact with target surfaces until some action is taken by a user to "activate" the material to reveal adhesive properties. Accordingly, selectively-activatible properties differ from permanently-active strips of adhesive which rely upon removal of liner materials (typically silicone-coated paper strips) to expose the adhesive for use.

Selective activation of such materials allows the user to properly position opposing surfaces before activation and adhesion are accomplished, as well as minimizing the likelihood of contamination of the closure means by contents during filling operations. This characteristic permits the storage container to be opened, filled, and/or manipulated in any desired mode without encountering the difficulties of premature clinging or adhering of the closure means to itself or to other portions of the opening or container body, and without the need for separate release sheets, liners, spacers, or the like. Preferably, the selective activation process is reversible such that the closure means may be de-activated and the container opened for filling or removal of contents and then re-activated for further closure without significant loss of adhesive capability.

Although material utilized for the closure means may be provided with two active sides or surfaces, if desired for particular applications, in accordance with the present invention it is presently preferred to provide such material with only one active side and one inactive or inert side. While under some circumstances it may be acceptable or desirable to design the closure material so as to form a discontinuous bond pattern with itself or another target surface, such as by having an intermittent or discontinuous layer of adhesive on its active surface, it is presently preferred that the closure material be designed so as to exhibit the ability to form a continuous seal or bond with itself and with any sufficiently continuous target surface.

Regardless of the manner of activation, materials useful as a closure means in accordance with the present invention will exhibit an adhesive, adherent, or tacking character as opposed to merely a clinging or affinity character. As utilized herein, therefore, the term "adhesive" is utilized to refer the ability of a material to exhibit an adherent character whether or not it actually includes a composition commonly understood and labelled as an adhesive. Accordingly, such materials will form a bond or seal when in contact with itself or another target surface as opposed to merely being attracted to such surface. While a number of approaches such as the use of selectively adherent materials may be utilized to provide the desired adhesive properties, a presently preferred approach is to utilize a pressure-sensitive adhesive.

When designing materials useful as a closure means in accordance with the present invention, it may be desirable to tailor the particular choice of adhesive agent so as to provide either a permanent bond or a releasable bond as desired for a particular application. Where a permanent bond is desired, opening of the storage container for access to the item(s) therein requires destruction of the container. Releasable bonds, on the other hand, provide access by permitting separation of the closure means from itself or other portions of the container at the bond site without destruction. Moreover, depending upon the activation mechanism employed in the design of the material, the releasable bond may additionally be refastenable if sufficient adhesive character remains after the initial activation/bonding/release cycle.

The closure materials useful in the present invention exhibit an adhesion sufficient to survive the likely degree of handling and external or internal forces the storage container is likely to encounter in use while maintaining the desired level of sealing engagement with the opposing surface such that preservation of perishable items is ensured. In general, minimum adhesion which maintains a seal is desired for a closure means, so that the closure means easily peeled open for access to the stored item(s).

Figure 4:
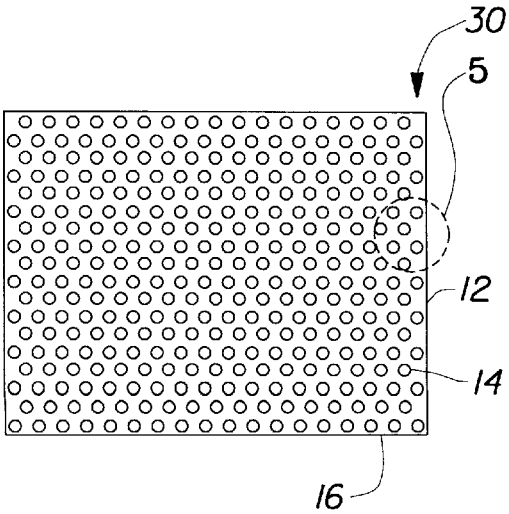
FIG. 4 is a top plan view of a preferred embodiment of a material suitable for use as a closure means of the present invention, disclosing a piece of material having truncated conical protrusions surrounded by an interconnected pattern of substance.
Figure 5:
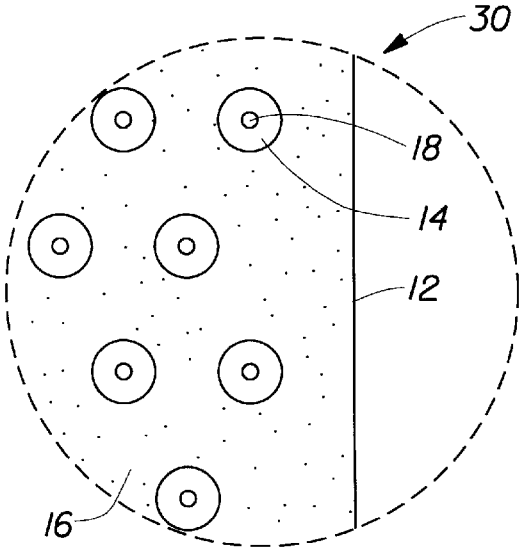
FIG. 5 is an enlarged partial top plan view of the material of FIG. 4, showing an array of protrusions.

FIGS. 4 and 5 illustrate a preferred embodiment of a material useful as a closure means for flexible storage containers according to the present invention, which comprises a three-dimensional sheet-like structure generally indicated as 30. Material 30 includes a deformed material 12 having hollow protrusions 14 and a layer of substance 16 located between protrusions 14. Protrusions 14 are preferably conical in shape with truncated or domed outermost ends 18. Protrusions 14 are preferably equally spaced in an equilateral triangular pattern, all extending from the same side of the material. Protrusions 14 are preferably spaced center to center a distance of approximately two protrusion base diameters or closer, in order to minimize the volume of valleys between protrusions and hence the amount of substance located between them. Preferably, the protrusions 14 have heights which are less than their diameters, so that when they deform, they deform by substantially inverting and/or crushing along an axis which is substantially perpendicular to a plane of the material. This protrusion shape and mode of deforming discourages protrusions 14 from folding over in a direction parallel to a plane of the material so that the protrusions cannot block substance between them from contact with a target surface.

Suitable representative three-dimensional materials of the type depicted in FIGS. 4 and 5 which include a thin layer of pressure-sensitive adhesive protected from inadvertent contact, as well as methods and apparatus for manufacturing them, have been developed and are described in detail in commonly-assigned U.S. Pat. No. 5,662,758, issued Sep. 2, 1997 to Hamilton and McGuire, entitled "Composite Material Releasably Sealable to a Target Surface When Pressed Thereagainst and Method of Making", and U.S. Pat. No. 5,871,607, issued Feb. 16, 1999 to Hamilton and McGuire, entitled "Material Having A Substance Protected by Deformable Standoffs and Method of Making", and commonly-assigned, co-pending U.S. patent application Ser. No. 08/745,339 (allowed), filed Nov. 8, 1996 in the names of McGuire, Tweddell, and Hamilton, entitled "Three-Dimensional, Nesting-Resistant Sheet Materials and Method and Apparatus for Making Same", U.S. patent application Ser. No. 08/745,340, filed Nov. 8, 1996 in the names of Hamilton and McGuire, entitled "Improved Storage Wrap Materials", all of which are hereby incorporated herein by reference.

Materials of the foregoing variety when utilized as a closure means in accordance with the present invention may be unitarily formed and constructed as part of the body of the storage container either before, during, or after assemblage of the container from its material components. Alternatively, such closure means may also be separately formed and joined to the body of the storage container either before, during or after assemblage of the container. Such joining may be edge-wise or may be accomplished as a lamination or bonding of the material facially onto a superposed portion of the container body, such lamination being particularly advantageous when it is desired to add additional thickness, stiffness, and/or resiliency to the region of the container comprising the closure means. The material utilized for the closure means may be the same as or different from the material utilized to form the container body either in dimensions or in composition.

Particularly useful as a flange material in accordance with the present invention is a self-supporting, semi-rigid, resilient polymeric or coated paper sheet material with a closure means laminated thereto such that the active side of the closure means faces away from the flange material, such that a composite closure means is formed having a plurality of highly-deformable stand-offs with a substantially more resilient, more self-supporting base material.

To facilitate separation of adhered or bonded overlying portions of the closure means material, various adaptations or modifications may be accomplished in terms of integration of the material into the overall structure of the storage container. For example, it may be desirable to provide extension tabs (such as tabs 35 shown in FIGS. 1–3) on opposing sides of the opening periphery to facilitate manual initiation of closure separation. To open the storage container of FIGS. 1–3, a user may grasp a pair of opposing tabs 35 and pull them in opposite directions to initiate and propagate separation of the opposed halves of flange 31, and hence closure means 30. It may also be desirable to leave a small but finite portion of the container immediately adjacent to the opening periphery free of closure material, such that there is a non-adherent rim of material which may be utilized to initiate material separation and hence opening of the storage container.

In accordance with the present invention, the use of selectively-activatible adhesive materials for the closure means 30 provides the user with an easy-to-operate closure means for closing and sealing an opening in a storage container. The closure means 30 is easy to manipulate with one or two hands, as the only dexterity required is to grasp or pinch the closure means with a pair of opposed digits to activate the material against an opposing surface of the container body or closure means. Moving the grasping digits across the extent of the opening provides secure adhesion of the closure means across the extent of the opening, thereby converting the storage container from a semi-enclosed container to a fully closed container.

The ability of the closure means to be activated by pinching or grasping superimposed portions of the container body is particularly advantageous with flexible, conformable structures such as the storage containers of the present invention. More particularly, such structures are yieldable under applied forces and accordingly, it would be difficult to activate a seal by exerting pressure upon the container as a whole against a surface, particularly when filled, as such would tend to expel contents as sealing of the closure is attempted. Therefore, the use of a closure means as herein described permits secure, reliable sealing of even highly flexible storage containers.

Because the closure means in a preferred configuration employs a layer of adhesive protected by a plurality of three-dimensional protrusions, rather than a three-dimensional mating pair of interlocking elements, it is possible to employ such a closure means successfully in a confined, non-parallel region of the container such as the region near the hinge 45 without providing leakage sites such as the ends of the mechanical elements. Accordingly, the closure means 30 of the present invention provides additional security and confidence in the level of sealing obtained for situations where a leakproof seal is important.

Figure 6:
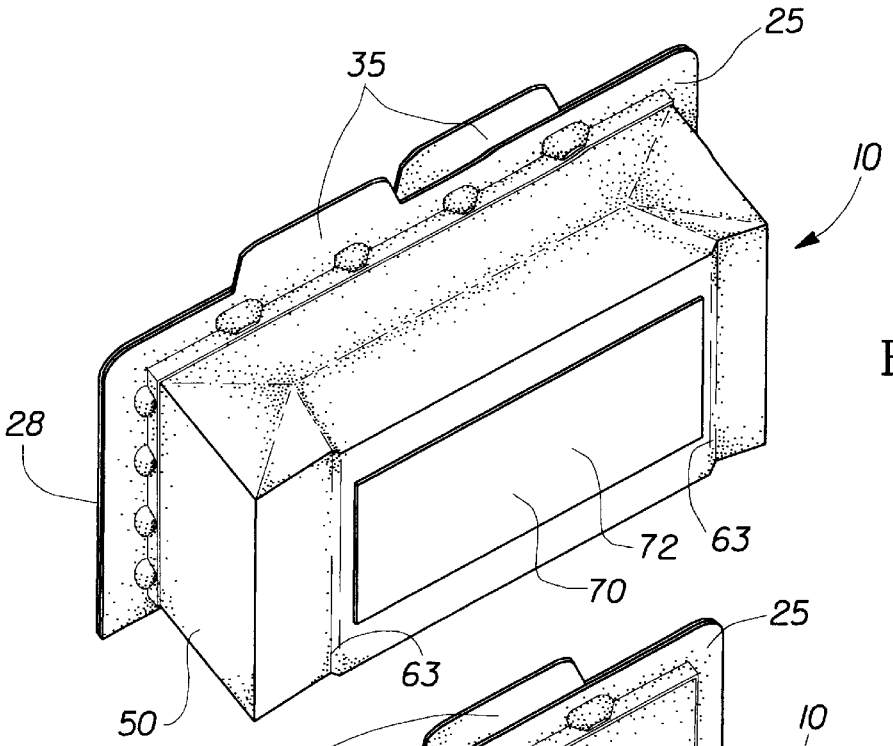
FIG. 6 is a perspective view of the storage container of FIG. 1 in a horizontal position in preparation for folding.
Figure 7:
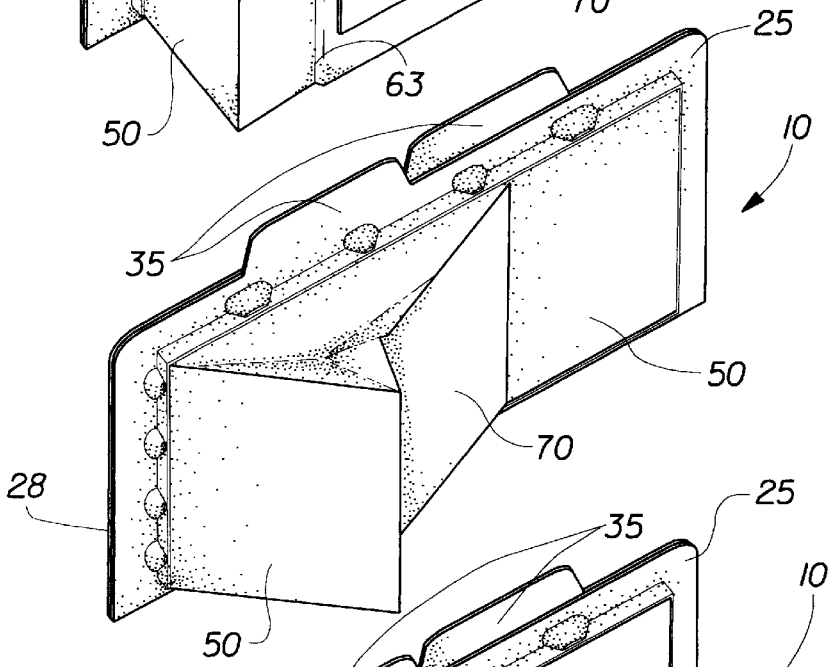
FIG. 7 is a perspective view of the storage container of FIG. 1 in a partially folded and collapsed condition.
Figure 8:
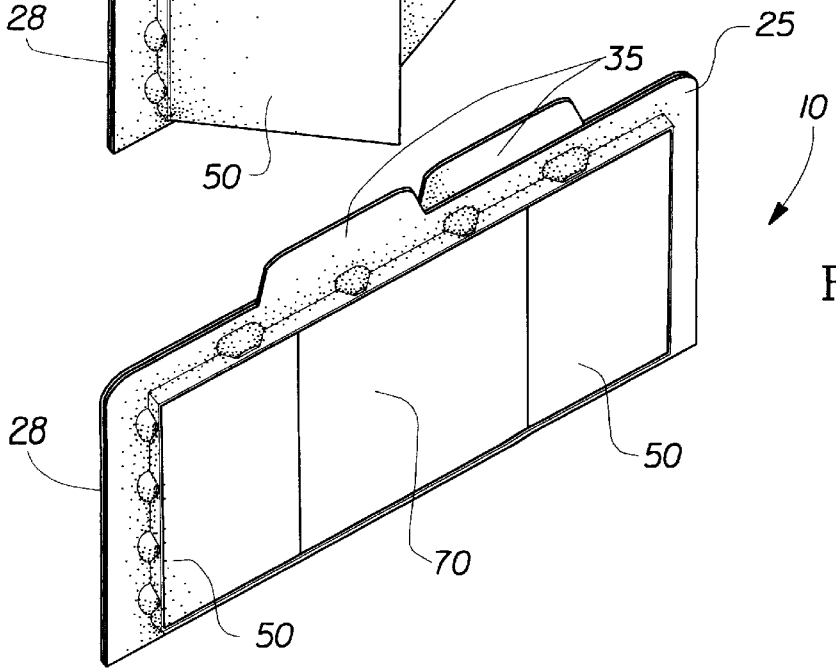
FIG. 8 is a perspective view of the storage container of FIG. 1 in a fully folded and collapsed condition.

In addition to being self-supporting, gusseted storage container 10 is also preferably readily foldable or collapsible to provide easy storage occupying minimal space. FIG. 6 depicts a gusseted storage container 10 as shown in FIG. 1 positioned laterally on its side in preparation for folding. FIG. 7 depicts a gusseted storage container 10 as shown in FIG. 1 but in a partially folded or collapsed condition. Accordingly, medial creases 61 have been pushed inwardly toward one another, bringing bottom edges 64 toward and generally parallel to the flange 25 FIG. 8 shows a gusseted storage container 10 in a more fully folded condition wherein folding continues until the bottom 70 is substantially parallel to and in close proximity to the flange 25 and the end panels are fully folded inwardly toward one another. Medial creases 61 could also be folded outwardly, if desired, which provides the additional feature of helping to erect the container when they are pushed inwardly. Also depicted in FIG. 6 is the optional reinforcing panel 72 which adds additional integrity and stability to the generally rectangular, planar bottom panel 70. To avoid negatively impacting upon the foldability of the container body, the reinforcing bottom panel 72 preferably includes creases which substantially align with lateral creases 63 for folding as depicted in FIGS. 6–8 or preferably is located between the creases 63, as shown.

The addition of additional reinforcement to the bottom panel lowers the center of gravity of the empty container for greater stability prior to and during filling, increases the stiffness of the bottom of the container for added stability in most circumstances filled or empty, and reduces the likelihood of the bottom of the container bowing when filled with heavier contents. The reinforcing panel may be of a similar material to the container body material or may be of a different more or less durable material, and is secured to the bottom panel by adhesive application or other suitable means. It is presently preferred that when a reinforcing panel is employed that it be placed on the exterior surface of the bottom panel rather than on the interior surface in order to provide support and reinforcement without adding additional surfaces, joints, and crevices on the interior of the container where they may provide sites for trapping portions of the contents and creating cleaning difficulties.

The flexible sheet material utilized to form the body of the container is sufficiently flexible and yieldable to accommodate the folding or collapsing of the container body between the open configuration of FIG. 1 and the closed configuration of FIG. 8. More particularly, the side panels 60 are sufficiently flexible to fold or pleat upon themselves as the end panels 50 pivot inwardly toward one another as the bottom panel 70 moves toward the lid 40.

Various compositions suitable for constructing the storage containers of the present invention include substantially impermeable materials such as polyvinyl chloride (PVC), polyvinylidene chloride (PVDC), polyethylene (PE), polypropylene (PP), aluminum foil, coated (waxed, etc.) and uncoated paper, coated nonwovens etc., and substantially permeable materials such as scrims, meshes, wovens, nonwovens, or perforated or porous films, whether predominantly two-dimensional in nature or formed into three-dimensional structures. Such materials may comprise a single composition or layer or may be a composite structure of multiple materials, including a substrate material utilized as a carrier for a substance. Materials found suitable for use in accordance with the present invention include a polypropylene film, 15 mil thickness, commercially available from Fina under the manufacturer's designation 3289M.

In addition to such use of sheet material folded and sealed to form the container body, the container body may be constructed in any known and suitable fashion such as those known in the art for making such containers in commercially available form. Heat or adhesive sealing technologies may be utilized to join various components or elements of the container to themselves or to each other. In addition, the container bodies may be thermoformed, blown, or otherwise molded from a starting blank or sheet of material rather than reliance upon folding and bonding techniques to construct the container bodies from a web or sheet of material.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container comprising:

(a) a semi-enclosed container body having a polygonal cross section and including a tubular structure having one open end and a bottom panel opposite said open end and enclosing one end of said container body, the open end of said tubular structure opposite from said bottom panel forming a substantially continuous outwardly-extending peripheral flange;

(b) a lid for selectively converting said semi-enclosed container to a closed container; and (c) a closure means for sealing said lid to said container body;

wherein said flange and said lid include a plurality of complementary recesses and protrusions to ensure alignment of said lid with said flange, wherein said lid and said flange have a plurality of linear side edges, each of said side edges on at least one of said lid and said flange including a plurality of said recesses.

2. The container of claim 1, wherein said recesses are upwardly concave.

3. The container of claim 1, wherein at least one of said lid and said flange include a selectively-activatible adhesive material.

4. The container of claim 1, wherein said lid includes a downwardly extending central panel which forms a plug seal with said container body.

5. The container of claim 1, wherein said tubular structure has a substantially rectangular cross-sectional shape.

6. The container of claim 1, wherein said lid is joined to said flange by a living hinge.

7. A container comprising:

(a) a semi-enclosed container body having a polygonal cross section and including a tubular structure having one open end and a bottom panel opposite said open end and enclosing one end of said container body, the open end of said tubular structure opposite from said bottom panel forming a substantially continuous outwardly-extending peripheral flange;

(b) a lid for selectively converting said semi-enclosed container to a closed container; and (c) a closure means for sealing said lid to said container body;

wherein said flange and said lid include a plurality of complementary recesses and protrusions to ensure alignment of said lid with said flange, wherein said tubular structure includes two opposed side walls, two opposed end walls between said side walls, said side walls and said end walls together forming said tubular structure, each of said side walls including a gusset extending in a direction substantially parallel to said bottom panel, and wherein said side walls and said end walls are inwardly foldable toward one another, such that said container is collapsible in a direction normal to said lid and said bottom panel while being substantially self-supporting while said side walls and end walls are in their unfolded orientation.

8. The container of claim 7, wherein said side walls, said end walls, and said bottom panel are unitarily formed from a continuous sheet of material.

* * * * *